US009357894B2

(12) United States Patent
Chiu et al.

(10) Patent No.: US 9,357,894 B2
(45) Date of Patent: Jun. 7, 2016

(54) MOBILE ROBOTISTIC MOPPING MACHINE

(71) Applicant: EGENPOWER INC., Laguna Niguel, CA (US)

(72) Inventors: Yao-Hsi Chiu, Vancouver (CA); Fei-Yun Zhu, Shenzhen (CN)

(73) Assignee: EGENPOWER INC., Laguna Niguel, CA (US)

( * ) Notice: Subject to any disclaimer, the term of this patent is extended or adjusted under 35 U.S.C. 154(b) by 132 days.

(21) Appl. No.: 14/171,278

(22) Filed: Feb. 3, 2014

(65) Prior Publication Data

US 2014/0223678 A1 Aug. 14, 2014

(30) Foreign Application Priority Data

Feb. 8, 2013 (TW) ..... 102105306 A

(51) Int. Cl.
*A47L 11/28* (2006.01)
*A47L 11/40* (2006.01)

(52) U.S. Cl.
CPC ..... *A47L 11/28* (2013.01); *A47L 11/4002* (2013.01); *A47L 11/408* (2013.01); *A47L 11/4038* (2013.01); *A47L 11/4061* (2013.01); *A47L 11/4066* (2013.01); *A47L 11/4083* (2013.01); *A47L 2201/00* (2013.01); *A47L 2201/04* (2013.01)

(58) Field of Classification Search
CPC ..... A47L 11/00; A47L 11/02; A47L 11/03; A47L 11/10; A47L 11/28; A47L 11/40; A47L 11/4036; A47L 11/4038; A47L 11/4061; A47L 111/4063; A47L 11/4066; A47L 11/4072; A47L 11/408; A47L 11/4083; A47L 2201/00; A47L 2201/04; A47L 2201/06
USPC ..... 15/319, 340.1, 98
See application file for complete search history.

(56) References Cited

U.S. PATENT DOCUMENTS 6,493,612 B1 * 12/2002 Bisset ..... A47L 5/28 15/319
6,818,036 B1 * 11/2004 Seaman ..... A47L 5/362 15/319
7,320,149 B1 * 1/2008 Huffman ..... A47L 11/24 15/319
8,316,499 B2 * 11/2012 Dooley ..... A47L 13/256 15/147.1
8,898,844 B1 * 12/2014 Dooley ..... 15/319

(Continued)

FOREIGN PATENT DOCUMENTS

TW M394739 12/2010
TW M427121 4/2012

(Continued)

*Primary Examiner* — Mark Spisich
(74) *Attorney, Agent, or Firm* — Muncy, Geissler, Olds & Lowe, P.C.

(57) ABSTRACT

A mobile robotistic mopping machine is formed of a body frame, a mop cloth, a power device, and a control device. The power device includes two opposite wheels and two opposite motors connected with the respective wheels for driving the wheels to rotate to further enable the body frame via the wheels to make the mop cloth move forward for cleaning the ground. The control device is electrically connected with the motors for controlling the motors. When the body frame makes the mop cloth move forward for a predetermined distance, the control device can control and make one of the motors reversely rotate and meanwhile make the other keep normal rotation to further enable the body frame to make the mop cloth turn for a predetermined angle and then keep moving forward.

8 Claims, 11 Drawing Sheets

(56) References Cited

U.S. PATENT DOCUMENTS

2004/0031113 A1* 2/2004 Wosewick ..... A47L 11/10 15/98
2004/0031121 A1* 2/2004 Martin ..... A47L 9/02 15/246.2
2004/0204792 A1* 10/2004 Taylor ..... A47L 9/2805 700/245
2012/0260944 A1* 10/2012 Martins, Jr. ..... A47L 5/14 134/18

FOREIGN PATENT DOCUMENTS

TW M436438 9/2012
WO 2006/046053 * 5/2006

* cited by examiner

MOBILE ROBOTISTIC MOPPING MACHINE

BACKGROUND OF THE INVENTION

1. Field of the Invention

The present invention relates generally to a mobile robotistic cleaner and more particularly, to a mobile robotistic mopping machine.

2. Description of the Related Art

Common tools for cleaning the ground is a mop and a bucket. A user can soak the mop into the bucket having water therein and twist the mop to wring it out. After mopping the ground back and forth, the user can soak the dirty mop into the bucket, remove the dirt from the mop with the two hands, and finally twist the mop to wring it out again for the next mopping action. It is quite time-consuming and laborious for common people to repeat such operation before the ground becomes clean.

Although many wringers are capable of wringing the mops out quickly as disclosed, for example, in Taiwan Patent Publication Nos. M394793, M427121, and M436438, the mops still need to be operated manually to mop the ground after the mops are wrung out, so the improvement was still limited. To effectively enhance the convenience of mopping the ground Taiwan Patent No. 1345961 disclosed a mobile robotistic cleaner capable of automatically cleaning the ground for lightening the burden of people for cleaning. However, such mobile robotistic cleaner is structurally complicated and of limited cleaning effect; besides, in case that the brush mechanism is damaged or becomes dirty to need replacement, the brush mechanism must be detached along with the mopping dish connected therewith, so more trouble and inconvenience will occur.

SUMMARY OF THE INVENTION

The primary objective of the present invention is to provide a mobile robotistic mopping machine which is structurally simple and of preferable cleaning effect.

The foregoing objective of the present invention is attained by the mobile robotistic mopping machine formed of a body frame, a mop cloth, a power device, and a control device. The mop cloth is detachably mounted to the body frame for cleaning the ground. The power device is mounted to the body frame and includes two opposite wheels and two opposite motors. Each of the motors is connected with one of the wheels for driving each of the wheels to rotate to further enable the body frame via the normal rotation of the motors to make the mop cloth move forward. The control device is mounted inside the body frame and electrically connected with the motors for controlling the motors. When the body frame moves forward for a predetermined distance, the control device can control and make one of the motors reversely rotate and make the other keep normal rotation to further enable the body frame to make the mop cloth to turn for a predetermined angle, e.g. 30 degrees to 360 degrees, via the normal and reverse rotations of the wheels. In this way, the cleaning effect can be boosted.

In a preferred embodiment, the body frame includes a wing-shaped member having at least two extended portions. The mop cloth includes a base, a plurality of fibrous strips, and at least two fastening portions. Each of the fibrous strips is connected with a bottom side of the base. Each of the at least two fastening portions is mounted to a top side of the base and a mounting portion is formed between the base and each of the at least two fastening portions for inserting each of the extended portions thereinto. In this way, the mop cloth can be quickly detached from the body frame for convenient cleaning or replacement thereof.

In another preferred embodiment, a magnet is mounted to each of the at least two extended portions and at least two magnetically sensitive members are pressed against to a tops side of one of the at least two fastening members and magnetically fastened by the corresponding magnet for increasing a downward force applied to the mop cloth for boosting the cleaning effect of the mop cloth.

In another preferred embodiment, at least two magnets are mounted to a bottom side of the wing-shaped member and the mop cloth includes at least two magnetically sensitive members. Each of the fibrous strips is connected with the bottom side of the base. Each of the magnetically sensitive members is fixed to the top side of the base and magnetically fastened by one of the magnets for enhancing the convenience of assembly and disassembly.

In another preferred embodiment, the body frame includes a housing, a mounting portion to which the power device is mounted, a wing-shaped member to which the mop cloth is mounted, at least two linking members, and at least two resilient members. The mounting portion is mounted inside the housing and includes at least two first axial tubes. The wing-shaped member includes at least two second axial tubes. Each of the at least two second axial tubes is axially movably inserted into one of the at least two first axial tubes. Each of the at least two linking members is connected one of the at least two first axial tubes and one of the at least two second axial tubes. Each of the resilient members is sleeved onto one of the at least two linking members and stopped against an end wall of one said first axial tube and an end wall of one said second axial tube to keep a predetermined vertical distance between a bottom side of the mounting portion and a top side of the wing-shaped member for decreasing the burden resulting from the weight of the mop cloth for the power device.

In another preferred embodiment, an annular water container is sleeved onto the housing for providing adequate moisture for the mop cloth to keep the mop cloth moist while the mop cloth is working.

DETAILED DESCRIPTION OF PREFERRED EMBODIMENTS

Structural features and desired effects of the present invention will become more fully understood by reference to four preferred embodiments given hereunder. However, it is to be understood that these embodiments are given by way of illustration only, thus are not limitative of the claim scope of the present invention.

Figure 1:
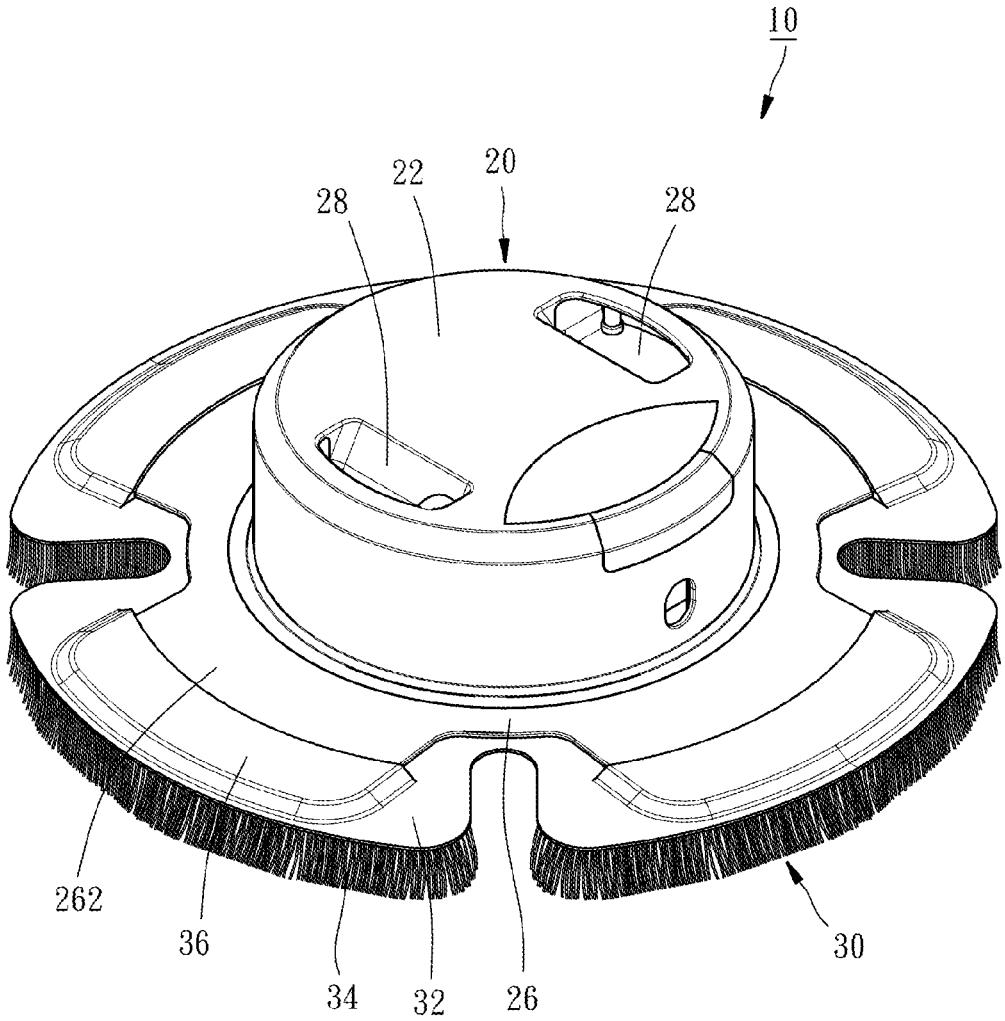
FIG. 1 is a perspective view of a first preferred embodiment of the present invention.
Figure 2:
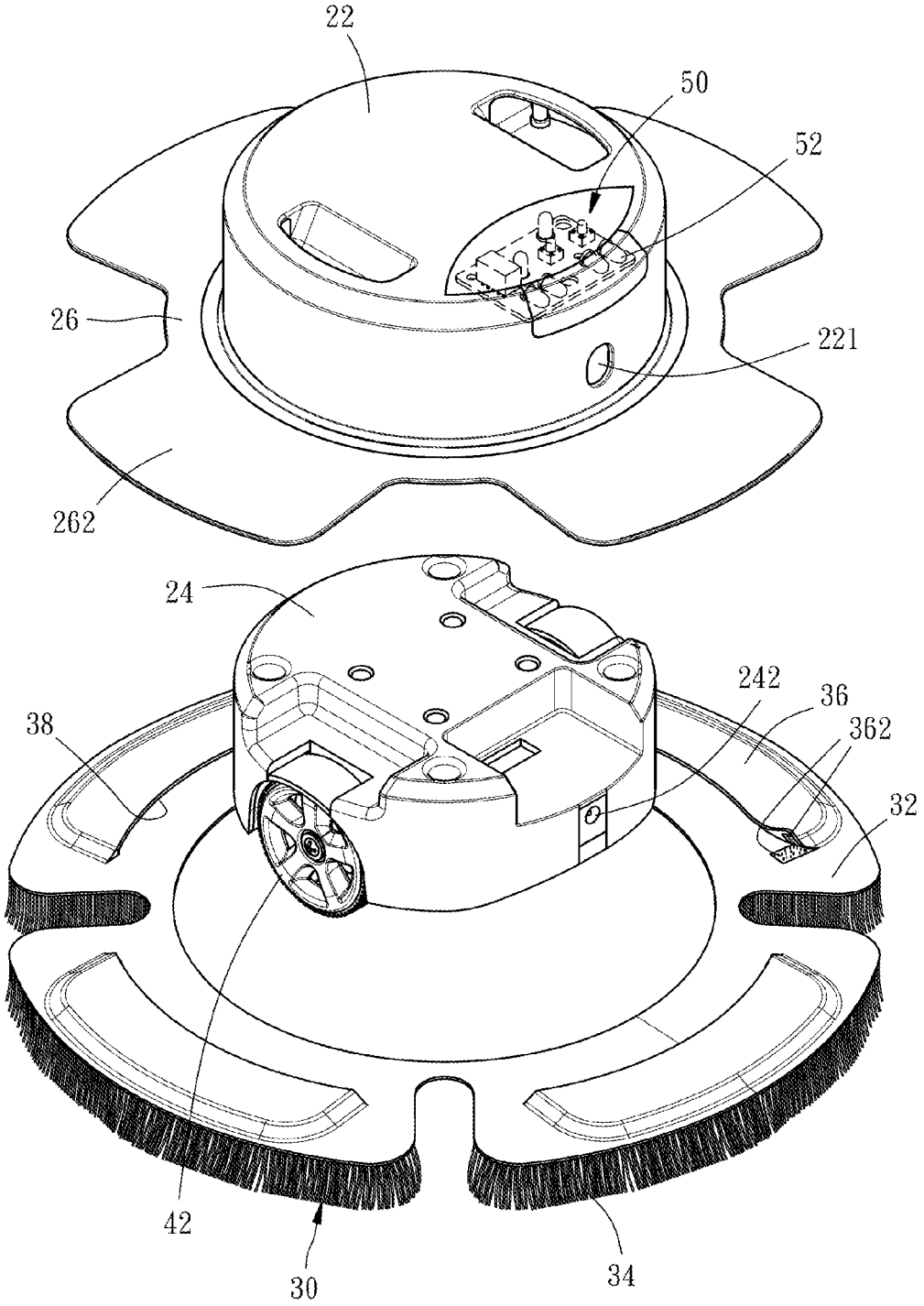
FIG. 2 is a partially exploded view of the first preferred embodiment of the present invention.
Figure 3:
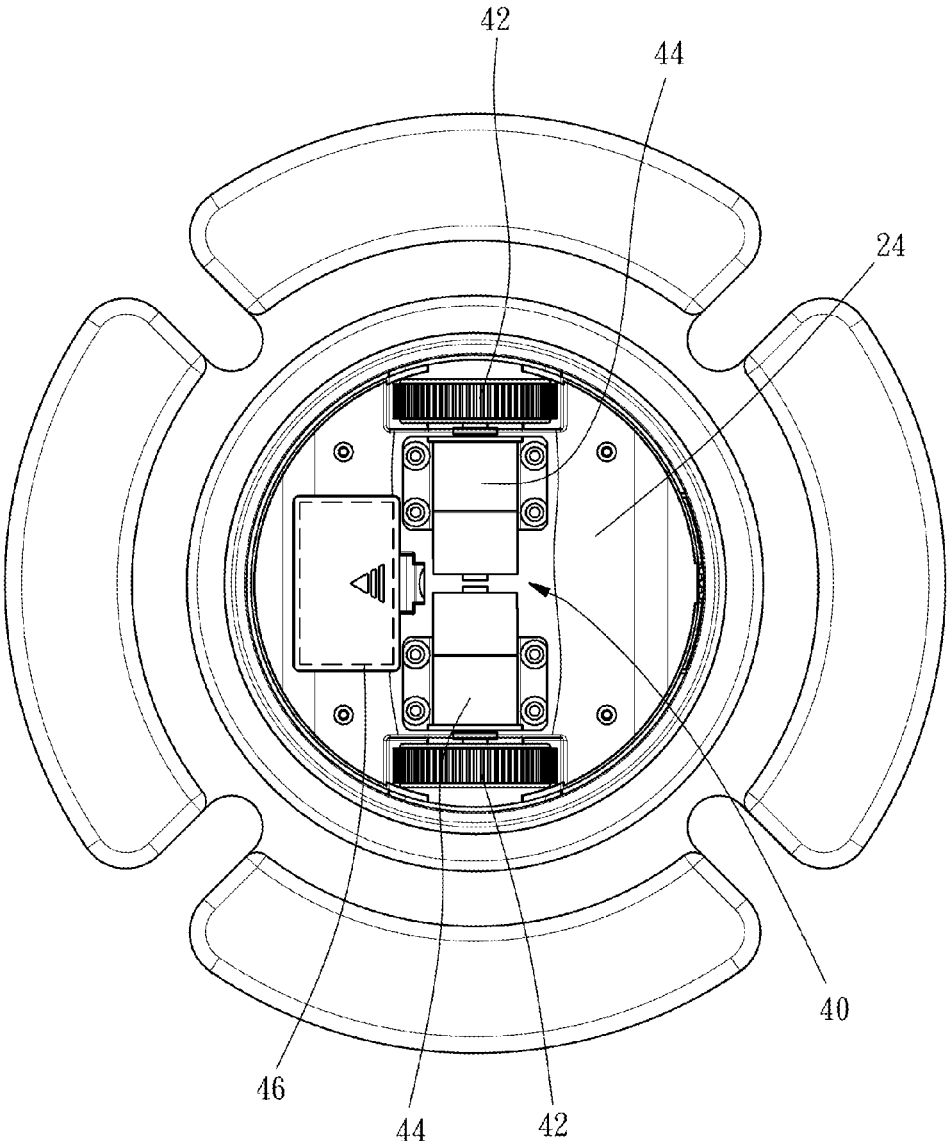
FIG. 3 is a bottom view of the first preferred embodiment of the present invention.

Referring to FIGS. 1-3, a mobile robotistic mopping machine 10 constructed according to a first preferred embodiment of the present invention is formed of a body frame 20, a mop cloth 30, a power device 40, and a control device 50. The detailed descriptions and operations of these elements as well as their interrelations are recited in the respective paragraphs as follows.

The body frame 20 includes a housing 22, a mounting portion 24, and a wing-shaped member 26. The housing 22 includes at least one handhold portion 28 recessed from a top side thereof for a user's fingers to engage, so the user can hold the handhold portion 28 to conveniently lift the body frame 20. The mounting portion 24 is fixed inside the housing 22. The wing-shaped member 26 is made of a soft plastic material, a soft rubber material, or either of other flexible plastic materials. The wing-shaped member 26 is connected with an external surface of the housing 22 and includes four extended portions 262 arranged symmetrically. In addition, at least one handhold portion 28 is two in number in this embodiment.

The mop cloth 30 includes a base 32, a plurality of fibrous strips 34, and four fastening portions 36. Each of the fibrous strips 34 is connected with a bottom side of the base 32 for cleaning the ground and adsorbing small litter. In actual practice, the fibrous strips 34 do not need to be soaked into the water or only need to be moistened a little. Each of the fastening portions 36 has one end fixedly stitched to a top side of the base 32. The other end of each fastening portion 36 is adhered to the top side of the base 32 via a Velcro® 362, so a mounting portion 38 is formed between each fastening portion 36 and the top side of the base 32 for inserting the extended portions 262 thereinto. In this way, the mop cloth 30 can be detachably mounted to the body frame 20.

Referring to FIG. 3 again, the power device 40 includes two opposite wheels 42, two opposite motors 44, and a rechargeable battery 46. Each of the wheels 42 is rotatably mounted to one of opposite sides of the mounting portion 24 and partially exposed outside a bottom side of the mounting portion 24. Each of the motors 44 is mounted inside the mounting portion 24 and connected with one of the wheels 42 for driving rotation of the corresponding wheel 42. The rechargeable battery 46 is installed inside the mounting portion 24 and electrically connected with the motors 44 for providing electric energy for the motors 44. To conveniently recharge the rechargeable battery 46, the mounting portion 24 includes a charging jack 242 for electric connection with the rechargeable battery 46. The housing 22 includes a through hole 221 communicating with the charging jack 242 for enabling a charging terminal of a battery charger (not shown) to be inserted into the charging jack 242 through the through hole 221.

Figure 4:
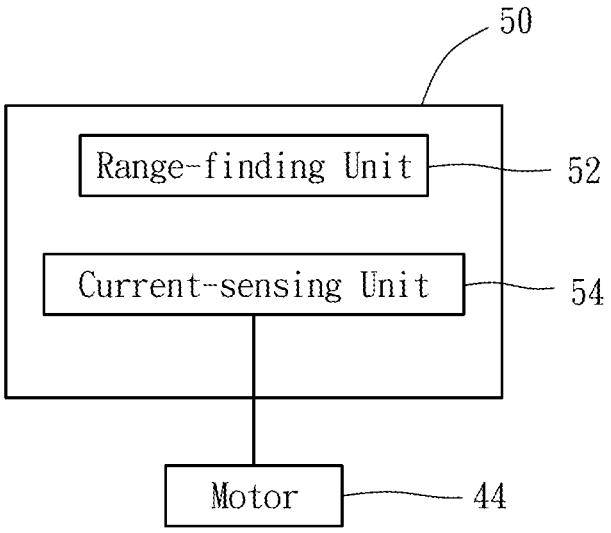
FIG. 4 is a block diagram of the first preferred embodiment of the present invention.

The control device 50 is mounted inside the housing 22 and electrically connected with the motors 44 and the rechargeable battery 46 for controlling operations (e.g. normal rotation, reverse rotation, or shutdown) of the motors 44. Referring to FIG. 4, the control device 50 includes a range-finding unit 52 for measuring the distance between the body frame 20 and an obstacle (not shown). When the measurement has a result, subject to the result of the measurement, the control device 50 controllably shuts down one of the motors 44 or reverses rotations of the two motors 44 synchronously for driving the body frame 20 to turn right or left or move backward to effectively parry the obstacle. The control device 50 further includes a current sensing unit 54 for sensing the variation of current magnitude, while the motors 44 are running. When the sensing has a result, subject to the result of the sensing, the control device 50 controllably makes the motors 44 react to match the ambient environment.

At the start, the motors 44 are controlled by the control device 50 to drive the wheels 42 to normally rotate synchronously along with the motors 44, so the body frame 20 can make the mop cloth 30 move forward for cleaning the ground. When the body frame 20 is moved for a predetermined distance (e.g. 10 meters) preset by the control device 50, the control device 50 controllably makes one of the motors 44 reverse rotation of the corresponding wheel 42 and meanwhile makes the other motor 44 drive the corresponding wheel 42 to keep normal rotation. In this way, the body frame 20 can make the mop cloth 30 to turn for a predetermined angle that falls within 30-360 degrees and is preferably 180 degrees; next, the control device 50 controllably makes the two motors 44 normally rotate to enable the body frame 20 to make the mop cloth 30 keep moving forward after the mop cloth 30 turns for the predetermined angle. After moving for the predetermined distance, the body frame 20 can make the mop cloth 30 turn again. In other words, the body frame 20 can keep making the mop cloth 30 move forward and turn until the ground becomes clean.

If it is intended to detach the mop cloth 30 from the body frame 20 for cleaning or replacement, the user only needs to unfix the fastening portions 36 from the Velcro® 362 to quickly separate the extended portions 262 from the mounting portions 38, respectively. When the mop cloth 30 is cleaned or replaced by a new one, the user only needs to put the extended portions 262 into the respective mounting portions 38 and then make the Velcro® 362 adhesively fasten the fastening portions 36, so the mop cloth 30 is successfully installed to the body frame 20.

Figure 5:
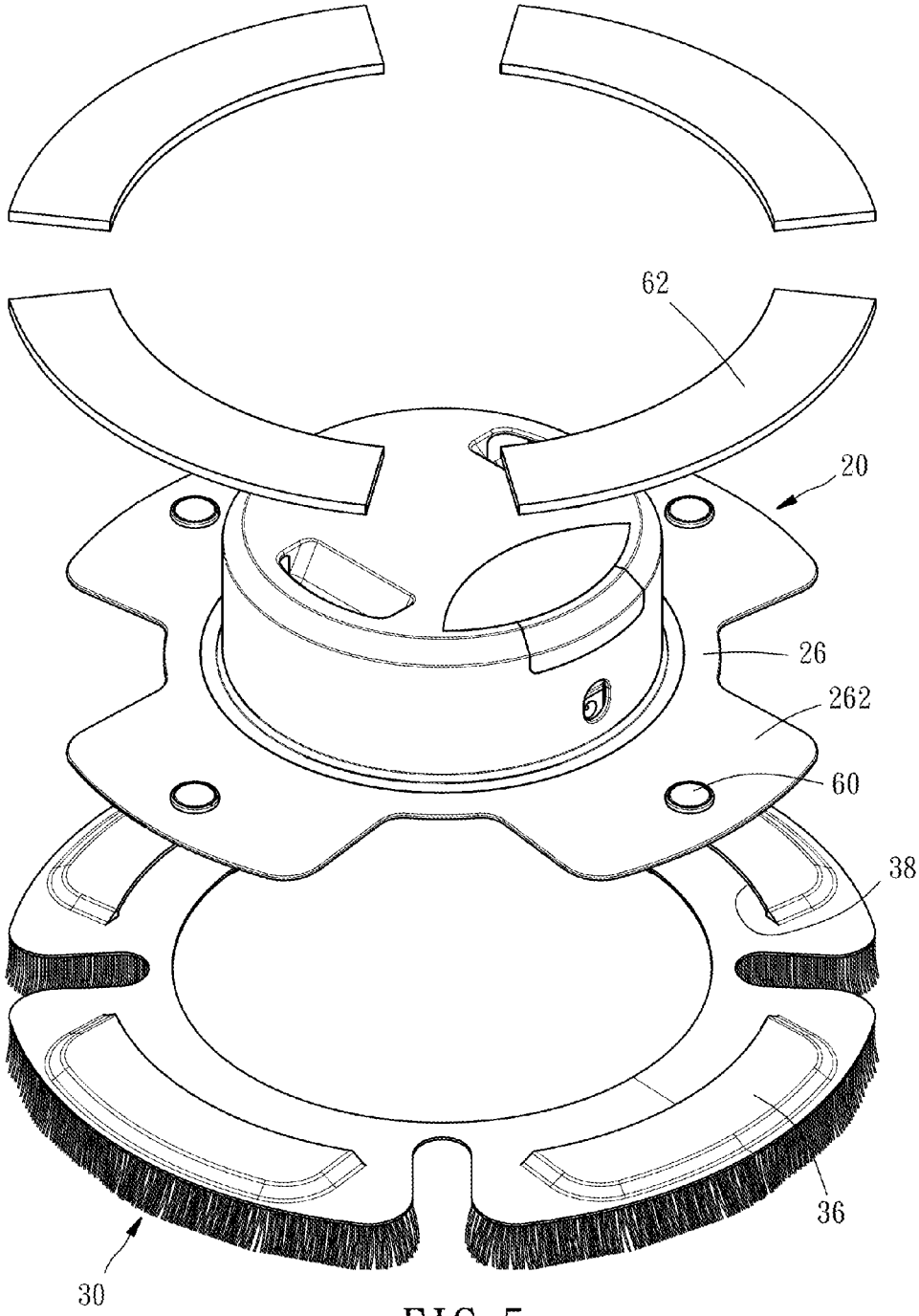
FIG. 5 is a partially exploded view of a second preferred embodiment of the present invention.

To match the texture of the ground to further increase the cleaning effect of the mop cloth 30, in a second preferred embodiment shown in FIG. 5, a magnet 60 is mounted to a top side of each extended portion 262. After the extended portions 262 are mounted into the respective mounting portions 38, four magnetically sensitive members 62 (e.g. metallic sheets) are pressed against respective top sides of the fastening portions 36 to be magnetically fastened to the corresponsive magnets 60, so a downward force applied to the mop cloth 30 is increased to effectively boost the cleaning effect of the mop cloth 30.

Figure 6:
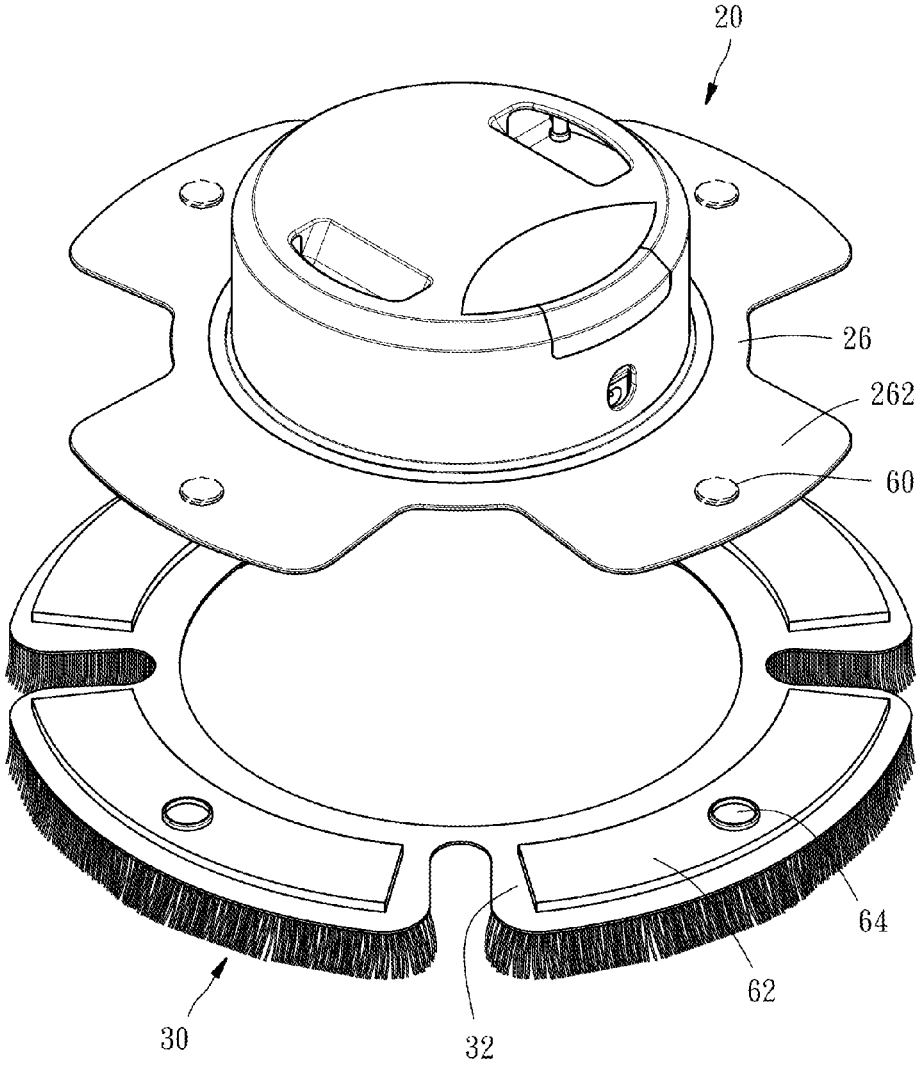
FIG. 6 is a partially exploded view of a third preferred embodiment of the present invention.

In addition, the locations of the magnets 60 and the magnetically sensitive members 62 are variable. For example, in a third preferred embodiment shown in FIG. 6, the magnets 60 are fixed to respective bottom sides of the extended portions 262 and the magnetically sensitive members 62 are fixed straight to respective top sides of the base 32 to replace the fastening portions 36. Each of the magnetically sensitive members 62 includes a top cavity 64 for one of the corresponsive magnet 60 to be fixed into. In this way, the body frame 20 and the mop cloth 30 can be quickly dismantled by easily separating the magnets 60 and the magnetically sensitive members 62 magnetically fixed to the respective magnets 60 from each other, so the mop cloth 30 can be conveniently replaced.

In light of the above, the mobile robotistic mopping machine 10 of the present invention is not only structurally simple but enhances the cleaning effect due to the turning of the mop cloth 30. Once the mop cloth 30 becomes dirty, the mop cloth 30 can be detached from the body frame 20 quickly for cleaning or replacement to definitely enhance the operational convenience.

Figure 7:
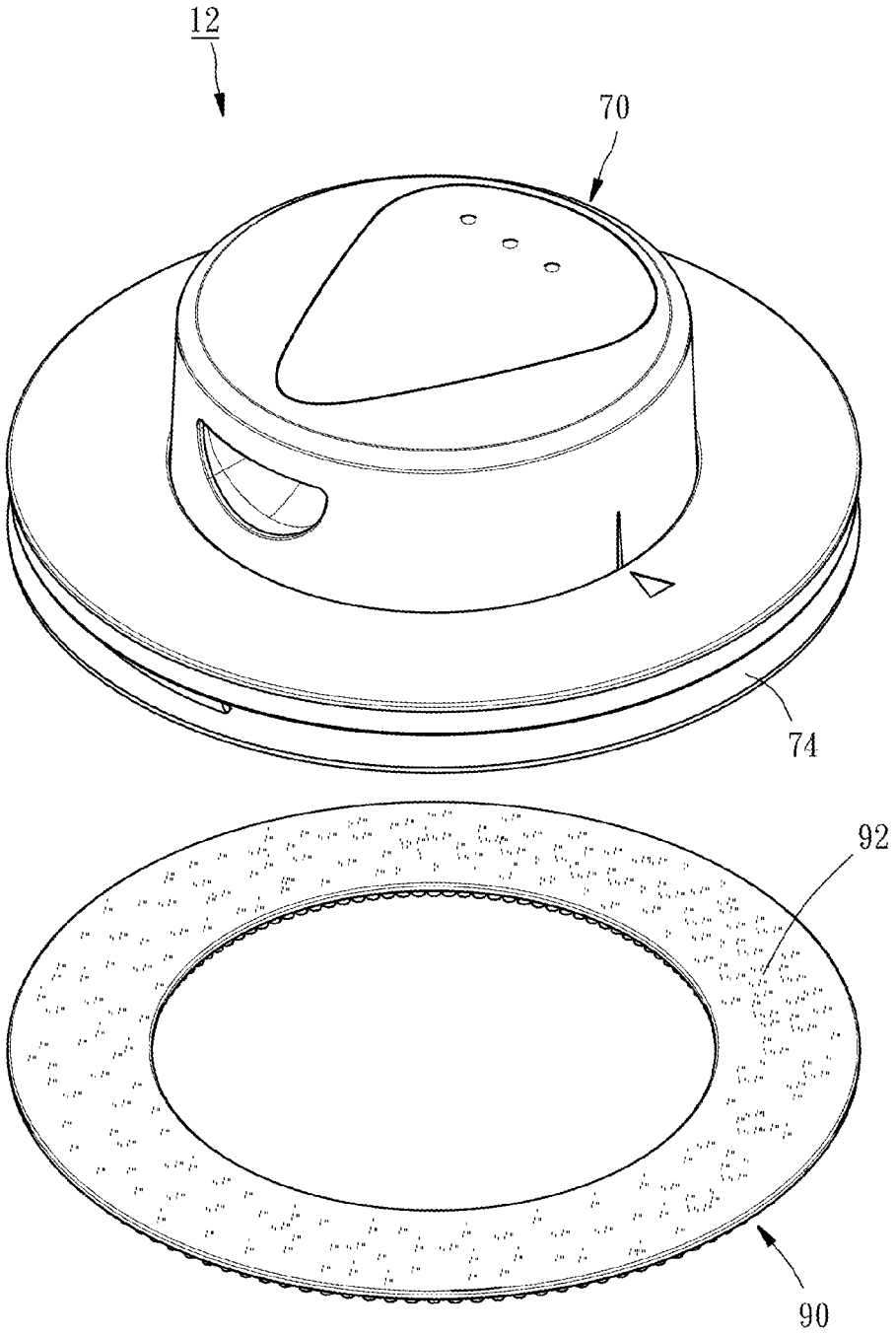
FIG. 7 is a partially exploded view of a fourth preferred embodiment of the present invention.
Figure 8:
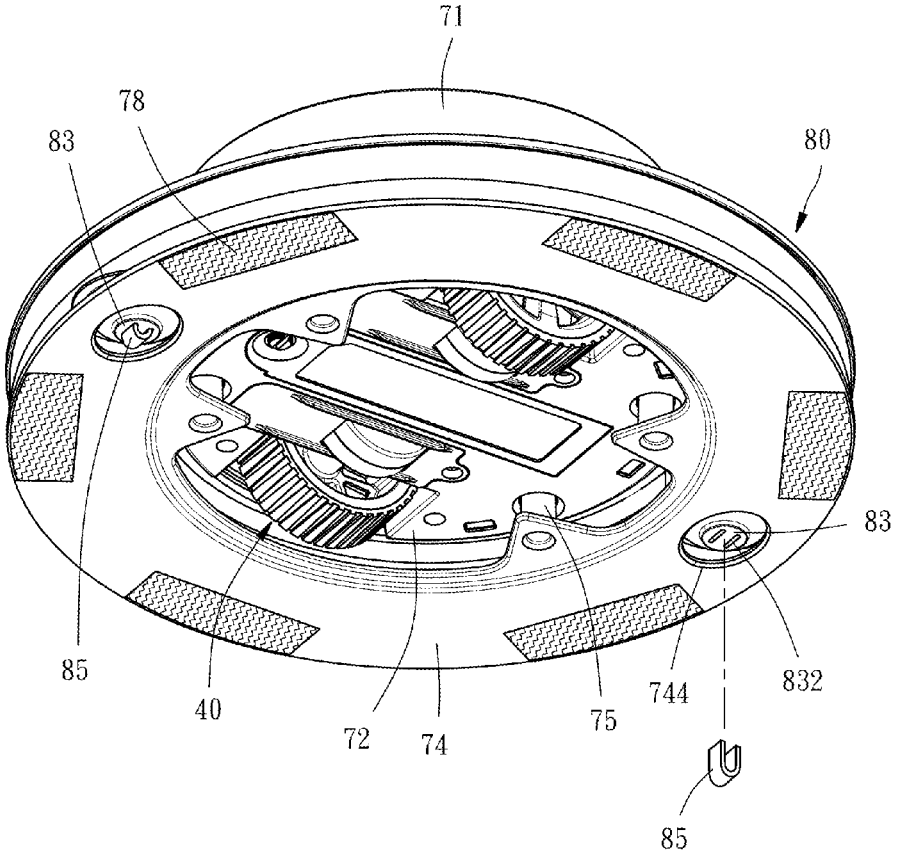
FIG. 8 is a perspective view of the fourth preferred embodiment of the present invention.
Figure 9:
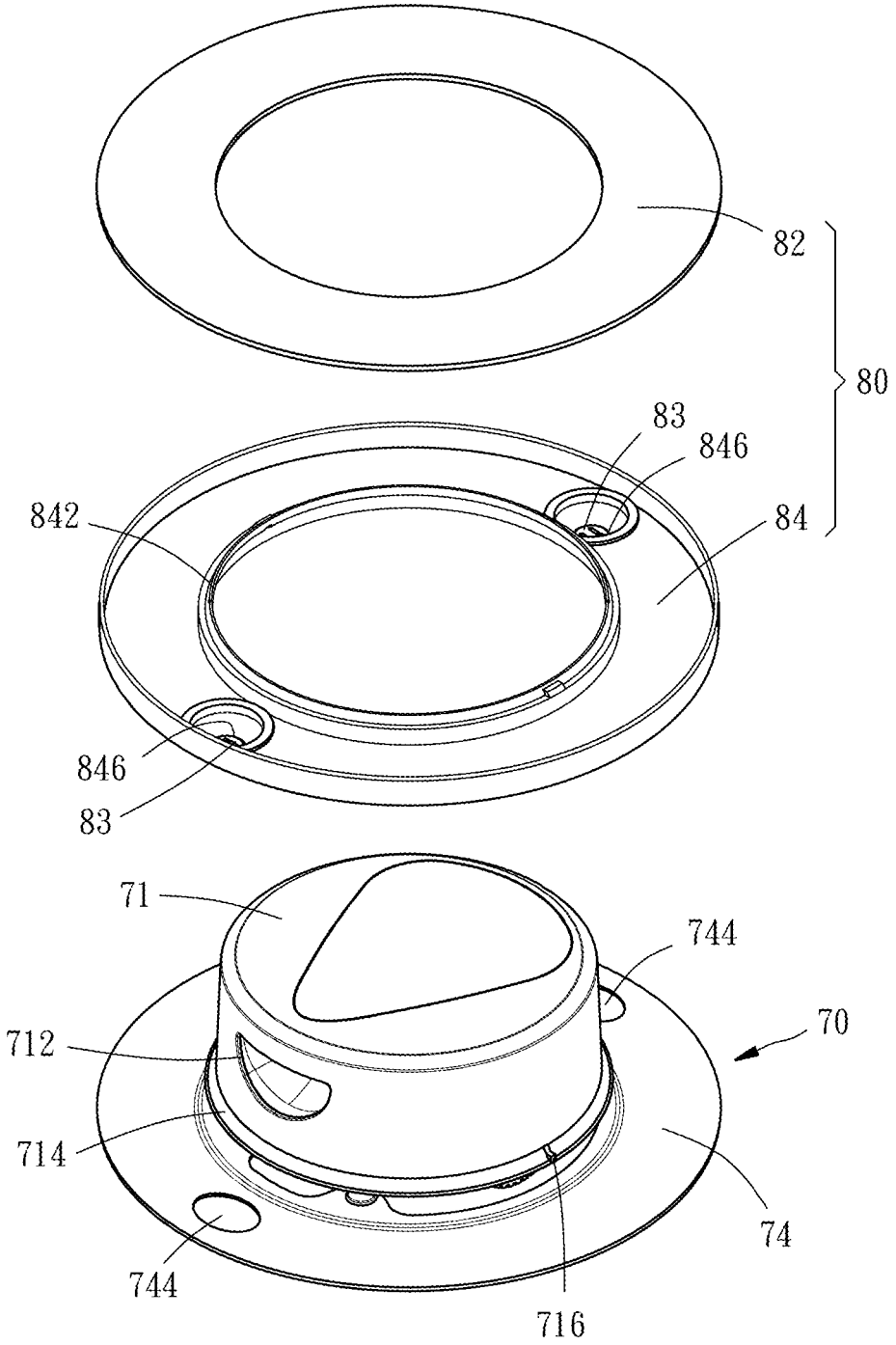
FIG. 9 is another partially exploded view of the fourth preferred embodiment of the present invention.
Figure 10:
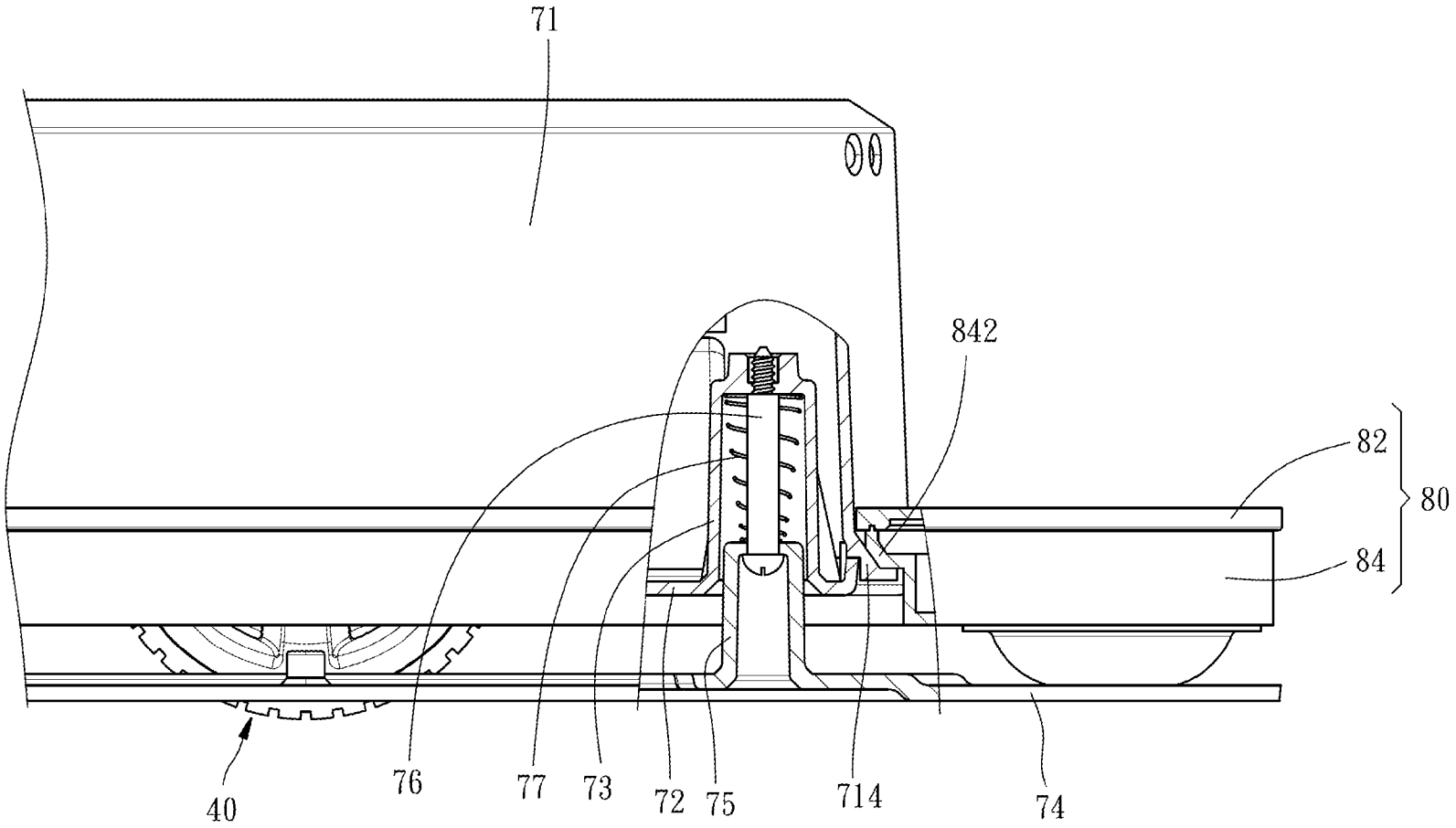
FIG. 10 is a partially sectional view of the fourth preferred embodiment of the present invention.

Referring to FIGS. 7-9, a mobile robotistic mopping machine 12 constructed according to a fourth preferred embodiment of the present invention is similar to that of the third preferred embodiment, having the difference lying in the structure of the body frame 70 and an annular water container 80. The housing 71 of the body frame 70 includes a handhold portion 712 located at an external side thereof. The mounting portion 72 is fixed inside the housing 71. Referring to FIG. 10, the mounting portion 72 includes four first axial tubes 73 extending upward from a top side thereof, and the wing-shaped member 74 includes four second axial tubes 75 extending upward from a top side thereof. In assembly, the second axial tubes 75 are inserted into the first axial tubes 73, respectively, and the first and second axial tubes 73 and 75 are interconnected together via linking members 76 (e.g. screw bolts), respectively. A resilient member 77 is sleeved onto each of the linking members 76 and is provided with two ends abutting against an end wall of the first axial tube 73 and an end wall of the second axial tube 75. In this way, after the assembly, a predetermined distance can be kept between a bottom side of the mounting portion 72 and a top side of the wing-shaped member 74 to decrease the burden resulting from the weight of the mop cloth 90 and applied to the power device 40.

Figure 11:
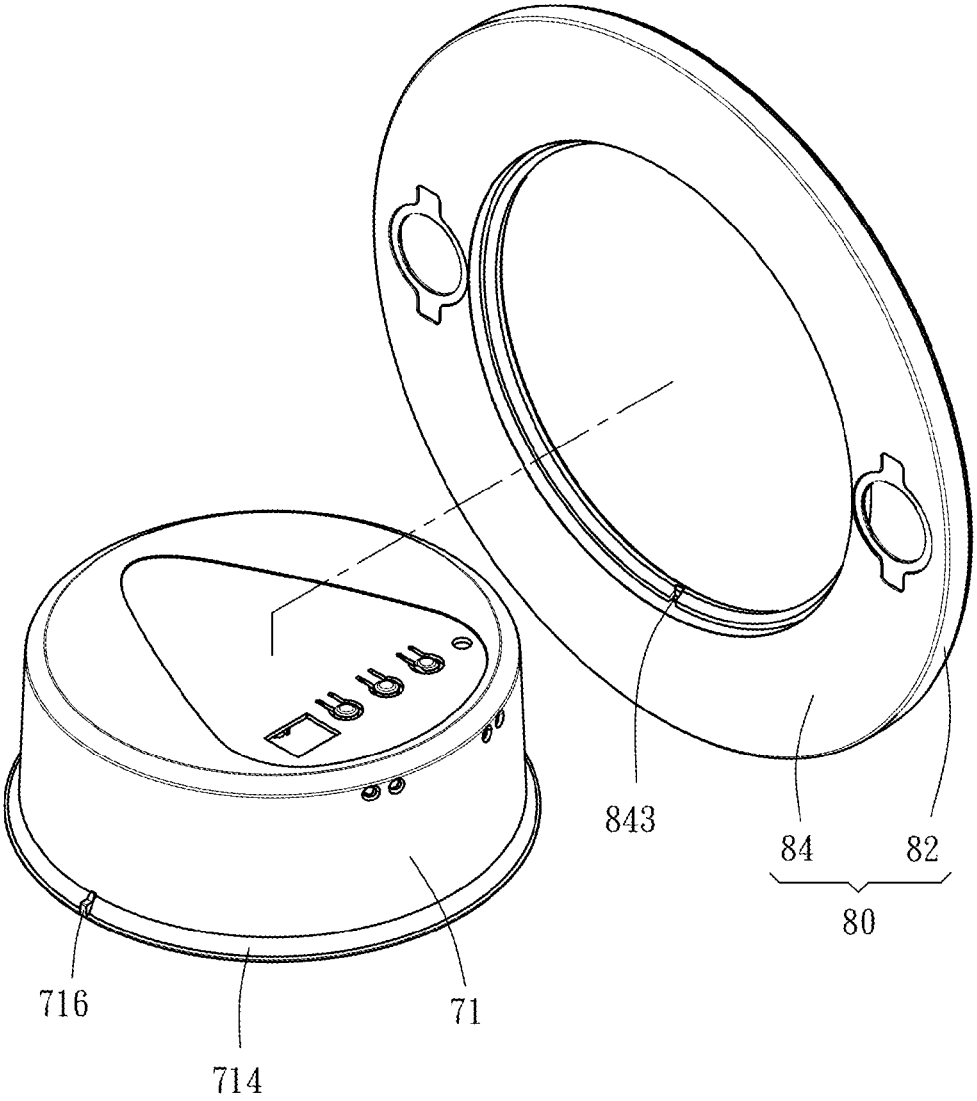
FIG. 11 is another partially exploded view of the fourth preferred embodiment of the present invention from which the mop cloth is removed.

Referring to FIGS. 9 and 10 again in view of FIG. 11, the annular water container 80 is formed an upper shell 82 and a lower shell 84 mounted to the upper shell 82. A chamber is formed between the upper shell 82 and the lower shell 84 for containing water. The lower shell 84 has a first retaining portion 842 formed at an internal edge thereof, two limiting concavities 843 formed at the first retaining portion, and two opposite upper inlets 846. An outflow plug 83 made of a soft plastic material is plugged into each of the upper inlets 846 and includes two outlets 832. A sub-outflow plug 85 made of a soft plastic material is plugged into each of the outlets 832 for controlling the outflow of the annular water container 80. To match the structure of the annular water container 80, the housing 71 includes a second retaining portion 714 formed at an external surface thereof and located below the handhold portion 712 and two limiting convexities 716 formed at the second retaining portion 714 and opposite to each other. The wing-shaped member 74 includes two opposite lower inlets 744. In assembly, the annular water container 80 is sleeved onto the housing 71 in a way that the first retaining portion 82 abuts against the second retaining portion 714 and the limiting concavities 843 are engaged with the limiting convexities 716, respectively, to make the annular water container 80 firmly mounted to the housing 71 and prevent the annular water container 80 from free rotation.

After the assembly, the upper inlets 846 can communicate with the lower inlets 744 through the outflow plug 83 and the sub-outflow plug 85, as shown in FIGS. 8 and 9, to make the water contained in the annular water container 80 be controlled by the sub-outflow plug 85 for its outflow and be provided for the mop cloth 90 through the lower inlets 744. In this way, the mop cloth 90 can keep moist for a long time to enhance the operational convenience. In addition, after the assembly, the mop cloth 90 can support the sub-outflow plug 85 and meanwhile, owing to the property of the soft plastic material, the outflow plug 83 can be properly deformed subject to a pressure of the annular water container 80 to prevent such pressure from excessive focus applied to the mop cloth through the sub-outflow plug 85 and leading to adverse influence on the cleaning effect of the mop cloth 90.

The assembly of the body frame 70 and the mop cloth 90 is a little different from those of the aforesaid preferred embodiments. Referring to FIGS. 8 and 9 again, the wing-shaped member 74 of the body frame 70 includes a plurality of male hook-and-loop fasteners 78 located at a bottom side thereof. The mop cloth 90 includes a female hook-and-loop fastener 92 located at a top side thereof. In assembly, the mop cloth 90 is adhesively mounted upward to the bottom side of the wing-shaped member 74 by means of the male hook-and-loop fasteners 78 and the female hook-and-loop fastener 92. When the mop cloth 90 becomes dirty, the mop cloth 90 can be quickly detached from the bottom side of the wing-shaped member 74 for cleaning or replacement, so the operation becomes more convenient.

What is claimed is:

1. A mobile robotistic mopping machine comprising:

a body frame;

a mop cloth detachably mounted to the body frame;

a power device mounted to the body frame and having two wheels opposite to each other and two motors opposite to each other, each of the motors being connected with one of the wheels for driving said one wheel to rotate; and a control device mounted inside the body frame and electrically connected with the motors for controlling the motors;

wherein when the body frame is synchronous with normal rotations of the two wheels to drive the mop cloth to move forward for a predetermined distance, the control device controls and makes one of the motors reversely rotate and makes the other normally rotate, so in this way, the body frame makes the mop cloth turn for a predetermined angle, and wherein the body frame comprises a housing, a mounting portion, a wing-shaped member, at least two linking members, and at least two resilient members, the mounting portion being mounted inside the housing, the mounting portion having at least two first axial tubes extending upward from a bottom side thereof, the wing-shaped member having at least two second axial tubes extending upward from a top side thereof, each of the second axial tubes being axially movably inserted into one of the at least two first axial tubes, each of the linking members being connected with one of the at least two first axial tubes and one of the at least two second axial tubes, each of the resilient members being sleeved onto one of the at least two linking members and abutting against an end wall of one said first axial tube and an end wall of one said second axial tube; the mop cloth being coupled to an external peripheral edge of the wing-shaped member; the power device is mounted to the mounting portion.

2. The mobile robotistic mopping machine as defined in claim 1, wherein after the body frame makes the mop cloth turn for the predetermined angle, the control device controls and makes the two motors normally rotate synchronously to enable the body frame via the normal rotations of the two wheels to make the mop cloth keep moving forward.

3. The mobile robotistic mopping machine as defined in claim 1, wherein the control device comprises a range-finding unit for measuring the distance between the body frame and an obstacle.

4. The mobile robotistic mopping machine as defined in claim 1, wherein the control device comprises a current sensing unit for sensing current magnitude of the motors.

5. The mobile robotistic mopping machine as defined in claim 1, wherein the body frame comprises a handhold portion.

6. The mobile robotistic mopping machine as defined in claim 1 further comprising an annular water container, wherein the annular water container is sleeved onto the housing and has a first retaining portion and a limiting concavity located at the first retaining portion; the body frame comprises a second retaining portion and a limiting convexity at an external side of the housing, the limiting convexity being located at the second retaining portion, the second retaining portion abutting against the first retaining portion, the limiting convexity being detachably engaged into the limiting concavity.

7. The mobile robotistic mopping machine as defined in claim 6, wherein the wing-shaped member comprises a lower inlet corresponding to the mop cloth; the annular water container comprises an upper inlet communicating with the lower inlet, an outflow plug being mounted inside the upper inlet, the outflow plug having an outlet, a sub-outflow plug being mounted inside the outlet.

8. The mobile robotistic mopping machine as defined in claim 1, wherein the mop cloth is adhesively mounted to a bottom side of the wing-shaped member by at least one male hook-and-loop fastener and at least one female hook-and-loop fastener.

* * * * *